US005369848A

United States Patent [19]

Huang

[11] Patent Number: 5,369,848

[45] Date of Patent: Dec. 6, 1994

[54] OPERATING ARM FOR STRAPPING MECHANISM

[76] Inventor: Han-Ching Huang, No. 12, Avenue 111, Lane 437, Jeng Hsin Road, Taichung, Taiwan, Prov. of China

[21] Appl. No.: 213,247

[22] Filed: Mar. 14, 1994

[51] Int. Cl.[5] ..... A44B 21/00; B25B 25/00

[52] U.S. Cl. ..... 24/68 CD; 24/68 B

[58] Field of Search ..... 24/68 CD, 68 R, 68 B, 24/71.2; 294/74

[56] References Cited

U.S. PATENT DOCUMENTS 4,199,182 4/1980 Sunesson .
4,227,286 10/1980 Holmberg ..... 24/68 CD
4,324,023 4/1982 Prete, Jr. ..... 24/68 CD
4,530,135 7/1985 Hsiang ..... 24/68 CD
4,809,953 3/1989 Kurita et al. ..... 24/68 CD
5,282,296 2/1994 Huang .

*Primary Examiner*—Victor N. Sakran
*Attorney, Agent, or Firm*—Charles E. Baxley

[57] ABSTRACT

An operating arm is engaged with ratchet gear of a strapping mechanism for operating the ratchet gear, the operating arm includes a pair of legs having one end engaged with the ratchet gear, a hand grip is formed integral with the other ends of the legs so as to increase the strength of the operating arm, the legs includes a number of projections for engaging with the ratchet gear so as to decrease frictional force between the ratchet gear and the legs.

1 Claim, 3 Drawing Sheets

OPERATING ARM FOR STRAPPING MECHANISM

BACKGROUND OF THE INVENTION

1. Field of the Invention

The present invention relates to an operating arm, and more particularly to an operating arm for a strapping mechanism which is provided to tighten and to lock slings or load-fastening belts.

2. Description of the Prior Art

A typical strapping mechanism is disclosed in U.S. Pat. No. 4,199,182 to Sunesson, issued on Apr. 22, 1980; another typical strapping mechanism is disclosed in U.S. Pat. No. 5,282,296 to Huang, who is the applicant of the present invention; in both of the strapping mechanisms, an operating arm is provided for operating the strapping mechanism and comprises a pair of laterally spaced apart legs interconnected by a handle, it is required to manufacture the legs and the handle separately and then to fix the same together so as to form the operating arm, this greatly increases manufacturing processes and costs.

The present invention has arisen to mitigate and/or obviate the afore-described disadvantages of the conventional strapping mechanisms.

SUMMARY OF THE INVENTION

The primary objective of the present invention is to provide an operating arm including a configuration that can be easily manufactured and that has a greatly increased strength.

In accordance with one aspect of the invention, there is provided an operating arm for a strapping mechanism having at least one ratchet gear engaged on a shaft, the operating arm comprising a pair of legs including a first end for rotatably engaging with the shaft and a second end, and a hand grip formed integral with the second end of the legs, the first end of the legs including a plurality of projections formed thereon for engaging with the ratchet gear so as to decrease frictional force between the ratchet gear and the legs.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
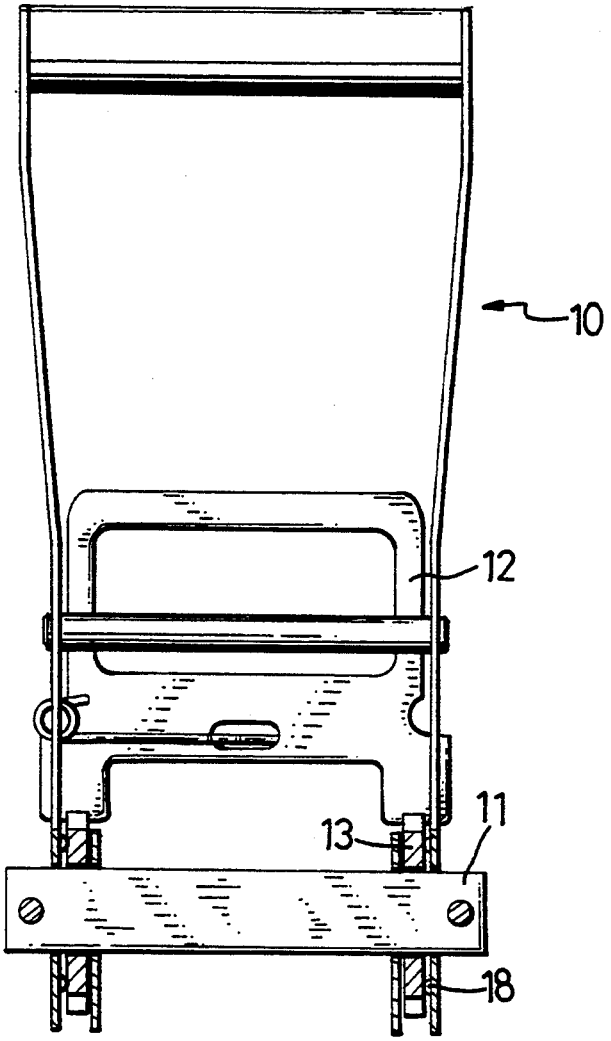
FIG. 1 is a partial cross sectional view of an operating arm for a strapping mechanism in accordance with the present invention.

Referring to the drawings, and initially to FIG. 1, an operating arm in accordance with the present invention is designed for a strapping mechanism which comprises a shaft 11 having two ratchet gears 13 rotatably disposed thereon, the operating arm 10 has one end rotatably engaged on the shaft 11, and a handle 12 slidably engaged in the operating arm 10 for engaging with the ratchet gears 13 and for operating the ratchet gears 13.

Figure 2:
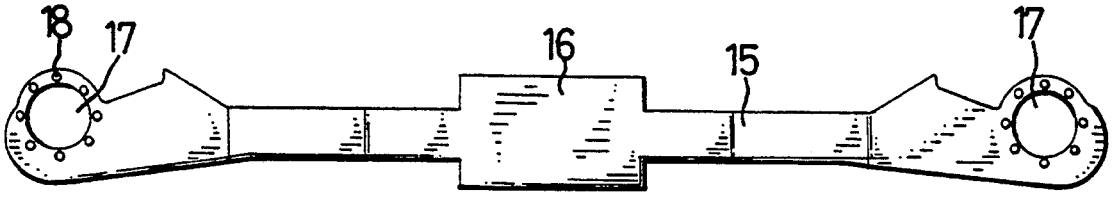
FIG. 2 is a plane view of a material to be formed into the operating arm.
Figure 3:
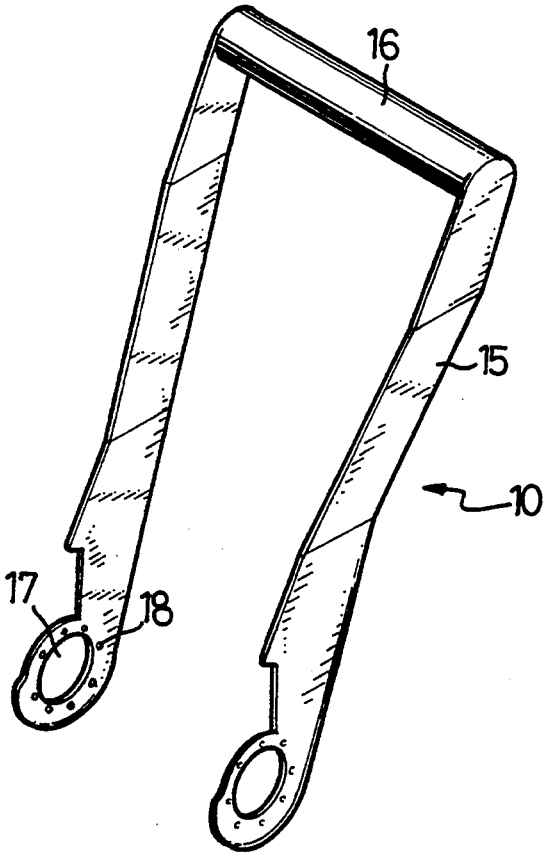
FIG. 3 is a perspective view of the operating arm.
Figure 4:
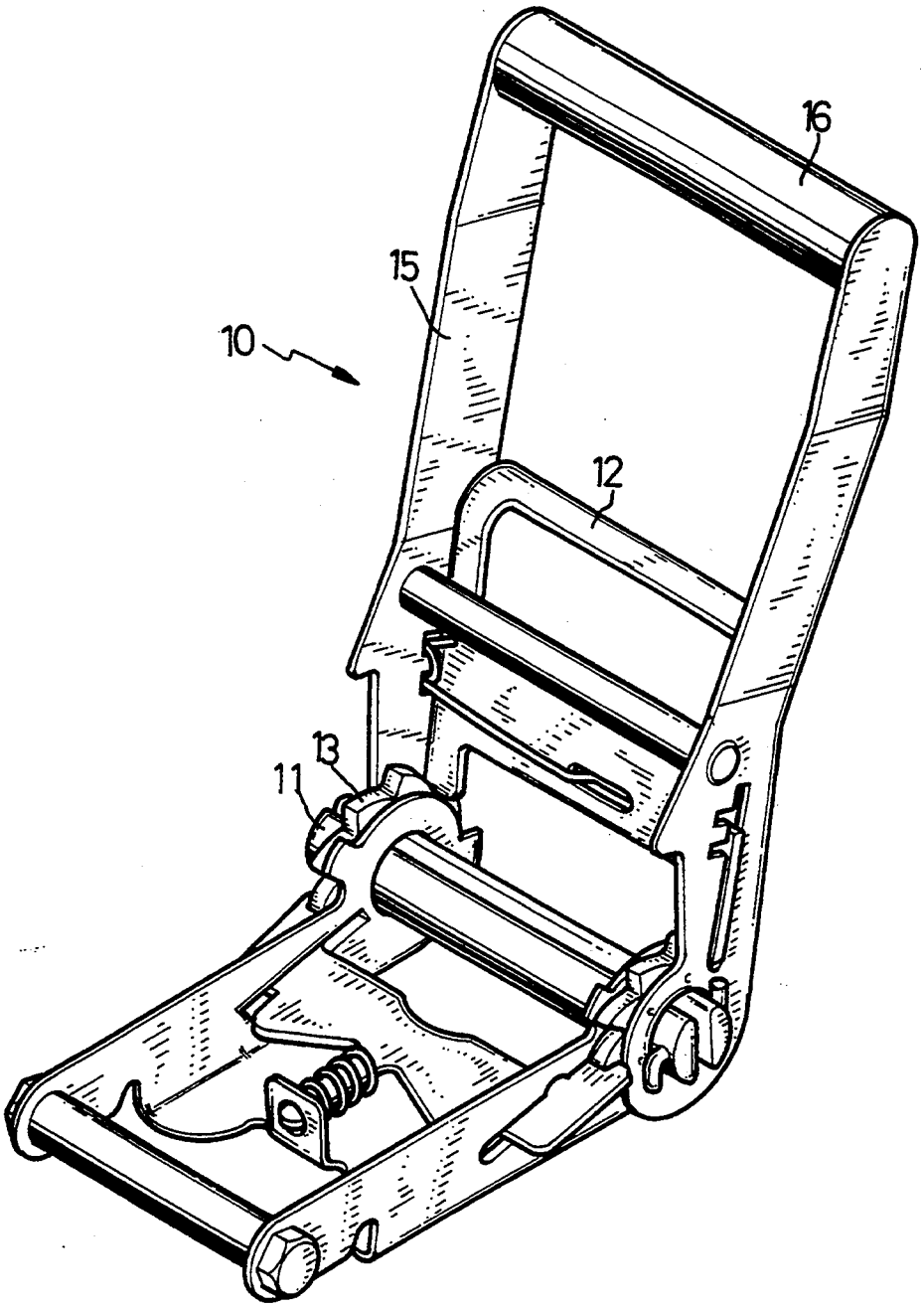
FIG. 4 is a perspective of a strapping mechanism employing the operating arm in accordance with the present invention.

Referring next to FIGS. 2, 3 and 4, the operating arm 10 is formed with a single strip of sheet material including a board 16 formed in the middle portion and to be wound to a cylindrical configuration so as to form a hand grip 16 for the operating arm 10, the sheet material including two legs 15 bent relative to the board 16, the free ends of the legs 15 each having an opening 17 formed therein for engaging with the shaft 11 of the strapping mechanism, and a plurality of projections 18 formed on the free ends of the legs 15 for engaging with the ratchet gears 13 and for applying a force against the ratchet gears 13 so as to stably retain the ratchet gears 13 in place, best shown in FIG. 1, it is to be noted that the projections 18 also greatly decreases the frictional force between the ratchet gears 13 and the free ends of the legs 15.

It is to be noted that the hand grip 16 and the legs 15 are solidly secured together such that the operating arm 10 includes an excellent strength, in addition, the sheet materials can be easily formed by punching processes, for example, the openings 17 and the projections 18 can be easily formed when the sheet material is formed such that the manufacturing cost can be greatly decreased.

Accordingly, the operating arm in accordance with the present invention includes a pair of legs and a hand grip solidly secured together such that the operating arm has a high strength configuration, in addition, the projections 18 greatly reduces the frictional forces between the ratchet gears and the legs.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An operating arm for a strapping mechanism having at least one ratchet gear engaged on a shaft, said operating arm comprising a pair of legs including a first end for rotatably engaging with said shaft and a second end, and a hand grip formed integral with said second end of said legs, said first end of said legs including a plurality of projections formed thereon for engaging with said ratchet gear so as to decrease frictional force between said ratchet gear and said legs.

* * * * *